US010203073B2

(12) United States Patent
Kohn et al.

(10) Patent No.: US 10,203,073 B2
(45) Date of Patent: Feb. 12, 2019

(54) SHABBAT BULB WITH GEAR CONTROLLED BLACKOUT MECHANISM

(71) Applicant: Lighting & Supplies, Inc., Brooklyn, NY (US)

(72) Inventors: Mordechai Kohn, Brooklyn, NY (US); John Luk, Flushing, NY (US)

(73) Assignee: Mordechai Kohn, New York, NY (US)

( * ) Notice: Subject to any disclaimer, the term of this patent is extended or adjusted under 35 U.S.C. 154(b) by 0 days.

(21) Appl. No.: 15/820,590

(22) Filed: Nov. 22, 2017

(65) Prior Publication Data

US 2018/0142844 A1 May 24, 2018

Related U.S. Application Data

(60) Provisional application No. 62/425,997, filed on Nov. 23, 2016.

(51) Int. Cl.

| | |
|---|---|
| ***F21K 9/65*** | (2016.01) |
| ***F21K 9/232*** | (2016.01) |
| ***F21K 9/66*** | (2016.01) |
| ***F21V 11/18*** | (2006.01) |
| ***F21V 14/08*** | (2006.01) |
| *F21Y 115/10* | (2016.01) |

(52) U.S. Cl.

CPC ..... *F21K 9/65* (2016.08); *F21K 9/232* (2016.08); *F21K 9/66* (2016.08); *F21V 11/183* (2013.01); *F21V 14/08* (2013.01); *F21Y 2115/10* (2016.08)

(58) Field of Classification Search

CPC ... F21K 9/65; F21K 9/232; F21K 9/66; F21V 14/08; F21V 11/183; F21Y 2115/10

See application file for complete search history.

(56) References Cited

U.S. PATENT DOCUMENTS

| | | | | |
|---|---|---|---|---|
| 3,016,454 | A * | 1/1962 | Simms | F21V 9/08 362/321 |
| 8,985,793 | B2 * | 3/2015 | Osaki | F21S 10/02 362/84 |
| 2005/0036322 | A1 | 2/2005 | Veffer | |
| 2012/0287652 | A1 * | 11/2012 | Breidenassel | F21V 29/004 362/373 |
| 2014/0355263 | A1 * | 12/2014 | Liao | F21V 14/08 362/231 |
| 2016/0186962 | A1 | 6/2016 | Kohn | |

* cited by examiner

*Primary Examiner* — Sonji N Johnson

(74) *Attorney, Agent, or Firm* — Bernard Malina

(57) ABSTRACT

A Shabbat bulb and a related method allows control of illumination without electrical intervention by a person observing strictures of Shabbat orthodox Jewish law. The bulb includes a blackout mechanism with shutter disc having at least one disc aperture for transmission of light and gear teeth; and an arm projecting radially outward from the shutter disc fitted with drive gear teeth. Manual rotation of the arm engages drive gear teeth with shutter disc gear teeth moving the disc apertures from an open to a closed position respectively allowing full or totally no illumination to exit the bulb.

9 Claims, 9 Drawing Sheets

SHABBAT BULB WITH GEAR CONTROLLED BLACKOUT MECHANISM

BACKGROUND OF THE INVENTION

Field of the Invention

The invention relates to a light emitting device which allows control of the illumination without electrical intervention by a person observing Shabbat (Sabbath) orthodox Jewish law. More specifically, full illumination can be adjusted downwardly by a purely mechanical gear mediated manipulation without touching the power or light source of the device.

The Related Art

Shabbat observant Jews may not turn on or off electrical switches or electrical devices and appliances from sundown Friday until after sunset on the following Saturday. This prohibition often forces a Shabbat observant family to leave some lights on during this period. These lights can be disturbing to some family members, most particularly those wishing to retire and go to sleep.

Automatic electric timers are widely used by these families to control the period of illumination. Among the disadvantages of the electric timers is that they need to be set up prior to Shabbat and that they cannot be adjusted during that day without violating religious prohibitions.

Currently there is a commercial light fixture for sale known as the KOSHER LAMP distributed by the Kosher Innovations Company and described in US Patent Publication Application No. 2005/0036322A1 titled "Lamp", invented by Samuel C. Veffer, filed Jul. 28, 2004. Therein is described a standalone lighting fixture that accepts a standard incandescent or CFL bulb or fluorescent device that remains on at all times. Light is released or blocked from entering a space or room by manually rotating a cylinder cover having a single small opening. The cylinder cover with opening revolves around the bulb or device for control of illumination.

There are several disadvantages to the KOSHER LAMP product. Firstly, the product is not bright enough for certain applications because only a small portion of light exits from the small opening in a limited projection. This constraint engenders eye strain on users of the lamp when reading because of the lack of brightness. Secondly, the KOSHER LAMP architecture consigns placement on a flat table top and cannot easily be adapted to a wall or ceiling. The product is simply not suitable for multiple mounting positions. Finally, the product has limited light beam coverage with difficulty in placing light simultaneously in many directions. The present invention overcomes the aforementioned drawbacks and provides many other advantages.

Other documents which may have relevance to the present invention include U.S. Pat. No. 2,841,695 (Bentsen). Therein described is a night light fitted with a shading shield mechanically adjustable via a manual control knob outside a housing for the night light.

Another document is US Patent Application Publication No. 2013/0128493 A1 (Osaki et al). Therein is described an illumination device employing a semiconductor light emitting element or diode (LED), a variable color fluorescent-substance unit and, cooperating therewith, a dimming unit. Neither structural features nor purpose of the dimming unit are directed at achieving a total blackout.

A still further document is U.S. Pat. No. 7,736,025 (Hofmann et al). Described therein is a device including an illumination source and a mechanical dimming device, the latter being an array of partially overlapping blades covering an optical passageway.

U.S. Pat. No. 3,830,562 (McGrann et al) reports a slit lamp for an ophthalmological instrument. Among features of the lamp is a single knob for varying slit width to adjust light intensity.

Finally, US Patent Application No. 2016/0186962 A1 (Kohn et al) describes a Shabbat bulb with a blackout mechanism on/off switchable by a slideable arm projecting outward from a slot along a periphery of the bulb. The switching mechanism suffers from several disadvantages. In practice we found the sliding movement of the arm tends to cause the separateable blackout mechanism to break apart from the electrical LED light source.

SUMMARY OF THE INVENTION

The present invention relates to a combination light source and light interrupter, herein referred to as a blackout mechanism, which passes (open position), interrupts (intermediate positions) or fully blocks (closed position) the flow of light from the light source into a space or room that would otherwise be illuminated by the light source. The blackout mechanism does not directly touch any part of the light source or any of its associated electrical activation parts. The light source remains on at all times. Within these times the blackout mechanism may be manually operated by a user to pass or block out the light from the light source into a space or room.

The subject invention reduces the inconvenience caused by a light fixture that remains electrically turned on by providing a combination light source and blackout mechanism that is suitable for reading or other purposes. It is easily and conveniently adapted to selectively provide light in any lighting fixture or light socket that will accept the combination of light source and blackout mechanism.

In accordance with the present invention, a light adjustable Shabbat bulb is provided which allows control of illumination without electrical intervention by a person observing strictures of Shabbat orthodox Jewish law, the bulb including:

- a housing covering an electrically operated light source, the housing having a power connecting end and an oppositely arranged illumination transmitting end, both ends being aligned along a common axis, and a screw thread formed externally on the housing adjacent the power connecting end for connection into an electrical socket;
- a blackout mechanism separable from the illumination transmitting end and having no operating connection with electrical circuitry, the mechanism including:
  - a ring oriented around the common axis, an opening formed on a periphery of the ring;
  - a shutter disc mounted within the ring including at least one disc aperture through which light from the light source is transmitted, the shutter disc having gear teeth arranged along at least a partial circumference of the shutter disc; and
  - an arm projecting radially outward from the shutter disc and projecting through the opening, the arm having drive gear teeth engaging the shutter disc gear teeth, manual rotation of the arm moving the disc apertures from an open position to a closed position thereby allowing full or totally no illumination to exit the bulb via the shutter disc.

Further provided is a method for non-electrically controlling illumination from a light bulb, the method including:

obtaining a Shabbat bulb which includes:

a housing covering an electrically operated light source, the housing having a power connecting end and an oppositely arranged illumination transmitting end, both ends being aligned along a common axis, and a screw thread formed externally on the housing adjacent the power connecting end for connection into an electrical socket;

a blackout mechanism separable from the illumination transmitting end and having no operating connection with electrical circuitry, the mechanism including:

a ring oriented around the common axis, an opening formed on a periphery of the ring;

a shutter disc mounted within the ring including at least one disc aperture through which light from the light source is transmitted, the shutter disc having gear teeth arranged along at least a partial circumference of the shutter disc; and an arm projecting radially outward from the shutter disc and projecting through the opening, the arm having drive gear teeth engaging the shutter disc gear teeth, manual rotation of the arm moving the disc apertures from an open position to a closed position thereby allowing full or totally no illumination to exit the bulb via the shutter disc.

inserting the bulb into a power delivery fixture and generating an illumination; and moving the arm from the open to the closed position on Shabbat by a person observing orthodox Jewish law.

The blackout mechanism is secured to the light source via a coupling mechanism. Most embodiments will have complementary interacting coupling mechanisms on both the light source and on the blackout mechanism. These complementary mechanisms may be male interacting with female devices. Suitable coupling mechanisms may be threaded, press-in, snap-in, twist-in, or lock-in couplings. Electricity supply to the light source is generally through a light socket of a lamp which then receives energy through connection to a power cord inserted into an AC wall outlet. Battery power may also be used to energize as a replacement for AC wall outlet power.

The invention may utilize a shutter disc with more than one disc aperture. The number of disc apertures may range from 1 to 50, more advantageously from 2 to 20, particularly from 3 to 10, and especially 6 disc apertures. In a light transmitting open position, there may be multiple light sources arranged within the housing. Particularly, the number of light sources (eg LEDs) are of equal number to the disc apertures. For instance, where there are 6 disc apertures, there will be three separate light sources each centered below one of the 6 disc apertures. Most suitable for this embodiment are multiple light emitting diodes (LEDs) or organic light emitting diodes (OLEDs). These diodes may be positioned on a circuit board supported in the housing. Preferably the diodes are equidistantly spaced (e.g. 120 degrees apart for a 3 diode set, and 60 degrees apart for a 6 diode set) on a surface of the circuit board. Advantageously, the disc apertures may have conically tapered bores along the disc aperture passageway.

BRIEF DESCRIPTION OF THE DRAWING

Further aspects, features and advantages of the Shabbat Bulb will become more readily apparent from consideration of the following appended figures in which.

DETAILED DESCRIPTION OF THE INVENTION

Figure 1:
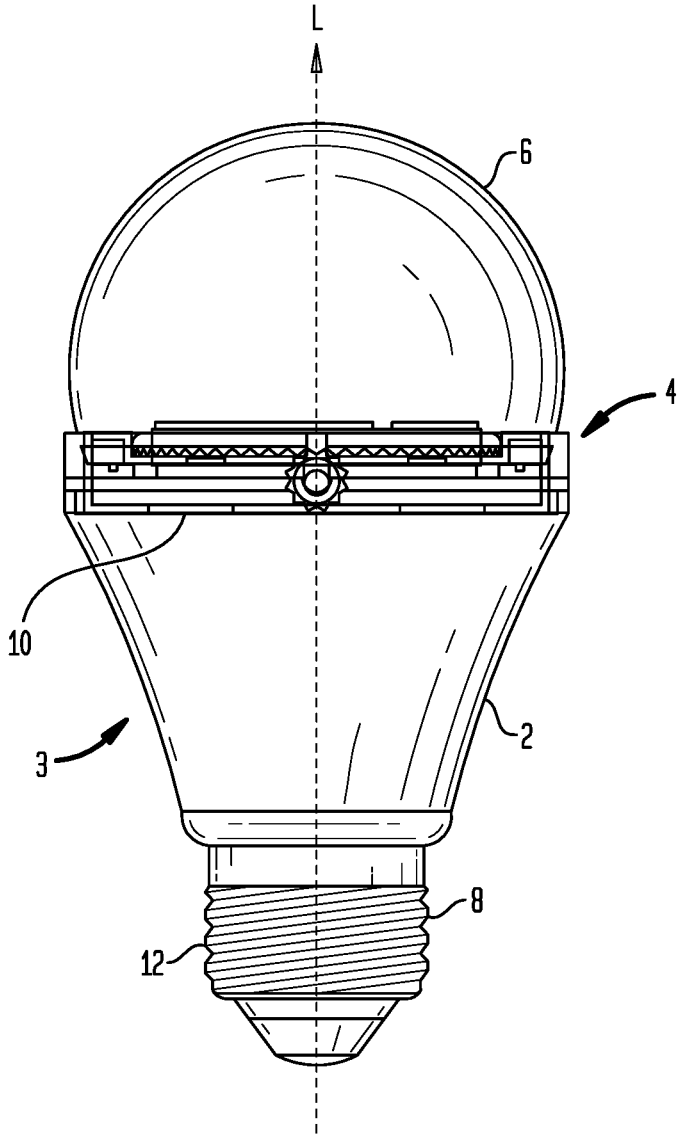
FIG. 1 is a front plan view of a Shabbat Bulb illustrative of the invention.
Figure 2:
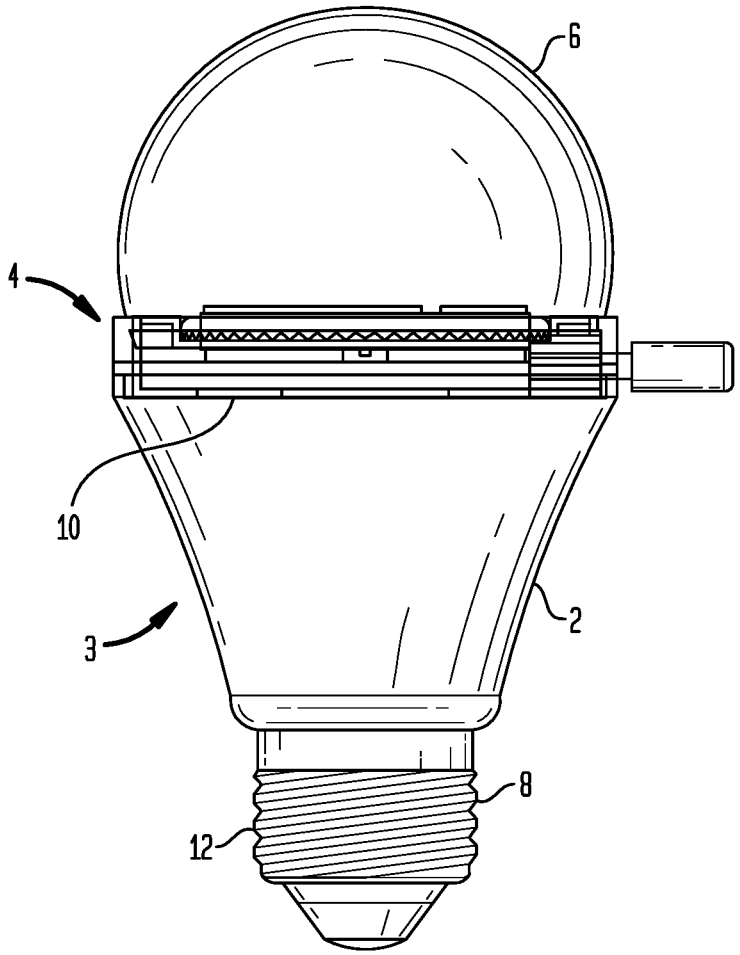
FIG. 2 is a side plan view of the Shabbat Bulb shown in FIG. 1.

FIGS. 1-2 illustrate a Shabbat bulb according to the present invention. The bulb features a housing 2 surrounding an electrically operated light source collectively designated as a light source assembly 3, a blackout mechanism constituting a blackout assembly 4, and a diffusion lens 6. The light source assembly has a power connecting end 8 and an oppositely arranged illumination transmitting end 10. Both ends 8 and 10 are aligned along a common axis L.

Adjacent the power connecting end is a screw thread 12 suitable for threaded connection into an electrical socket such as, but not limited to, a candelabra, GU24, bi-pin or other socket base. Housing 2 may advantageously have an E26 or A19 medium screw thread base which has wide compatibility with sockets.

Particularly useful light sources are LED lamps including discrete axial lead LEDs, surface mount LED, and LED dies with integral lenses. A driver (not shown) within the housing powers the LED. Alternatively, the light source may be a compact fluorescent source, an OLED, an electroluminescent source (EL), or incandescent filament.

Diffusion lens 6 may be formed of clear or frosted glass or plastic material. The lens surface may be smooth, faceted or textured dependent on the desired light beam dispersion and coverage.

Figure 3:
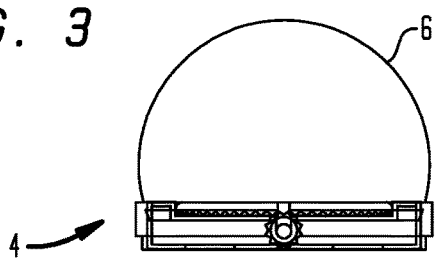
FIG. 3 is a side plan view of the blackout assembly section shown in FIG. 1-2.
Figure 4:
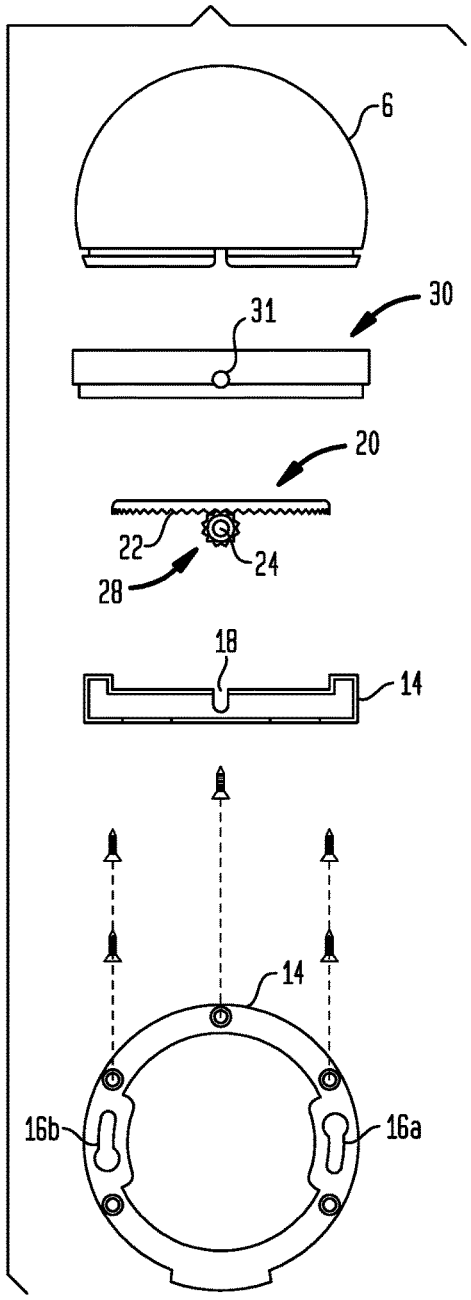
FIG. 4 is a two-dimensional sequential exploded view of components forming the blackout assembly shown in FIG. 3.

FIG. 3 illustrates the blackout mechanism, covered by the diffusion lens, separated from the light source assembly. A more detailed view of the blackout mechanism is presented by FIG. 4. Therein is shown a bottom view of an inner ring 14. Locking slots 16*a* and 16*b* are formed on opposite sides of the inner ring. These slots allow attachment to the light source assembly via two pins on the assembly. A U-shaped slot 18 is seen in a side view of the inner ring.

Next in the blackout assembly is a shutter disc 20 featuring along an outer circumference a set of crown gear teeth 22. Other embodiments may utilize crown gear teeth only partially surrounding the outer circumference. Advantageously, the crown gear teeth and shutter disc may be a single component molded or stamped together. For instance, the crown gear teeth and shutter disc may be formed as a unitary molded plastic part or a unitary stamped metal part.

Arm 24 projects radially outward from the shutter disc. On the outermost end as best shown in FIG. 4*b* is a knob 26. A set of drive gear teeth 28 are arranged on the arm inward of the knob. The drive gear teeth mate with the crown gear teeth. Manual rotational movement on the arm activates the drive gear teeth to translate force on the crown gear teeth thereby rotating the shutter disc orthogonal to the axis L.

Figure 4A:
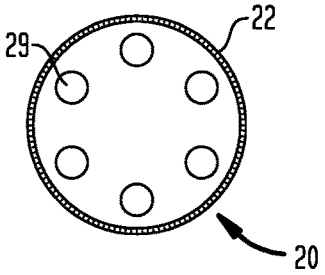
FIG. 4*a* is a top plan view of the shutter disc component shown in the FIG. 4 exploded view.
Figure 4B:
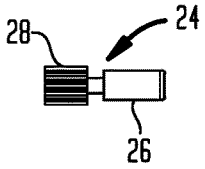
FIG. 4*b* is a side plan view of the arm component capped by a knob shown in the FIG. 4 exploded view.

FIG. 4*a* provides a top plan view of the shutter disc and reveals six disc apertures 29. In the illustrated embodiment, gear induced movement of the shutter disc allows light to exit the blackout assembly (open position) or totally prevent exit of light (closed position) dependent upon alignment with 9 the disc apertures. Continuous rotation of the arm via the knob moves the shutter disc a through full 360° arc. Six totally open and totally closed positions are thereby traversed.

The blackout mechanism further includes an outer ring 30. An opening 31 is formed on a periphery of the outer ring through which can protrude a part of the arm. Assembled the shutter disc is supported between the outer and inner rings.

Figure 5:
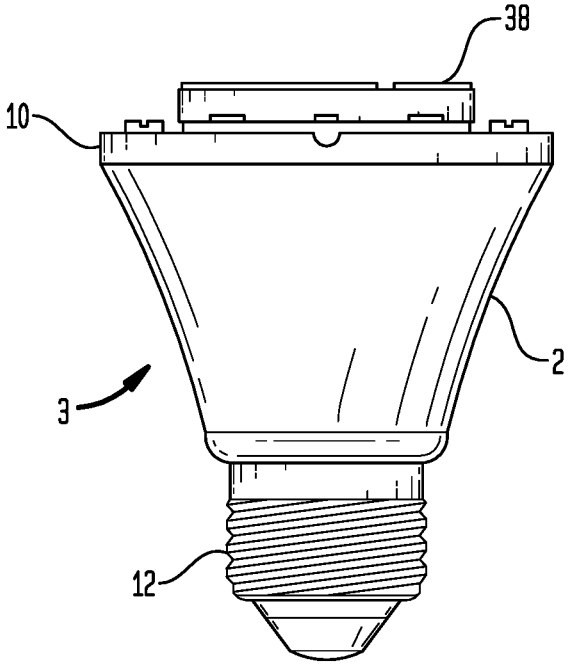
FIG. 5 is a side plan view of the light source assembly shown in FIG. 1-2.
Figure 5A:
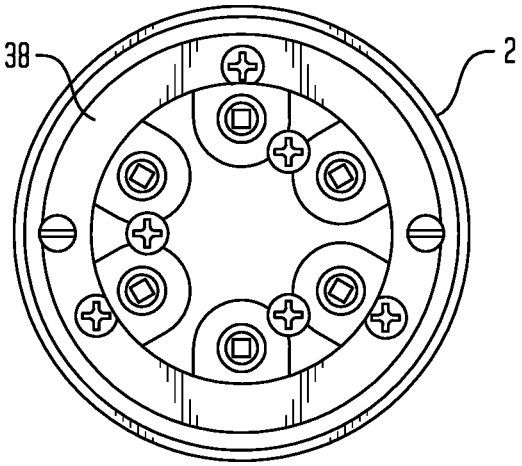
FIG. 5*a* is a top plan view of the light source assembly shown in FIG. 5.
Figure 6:
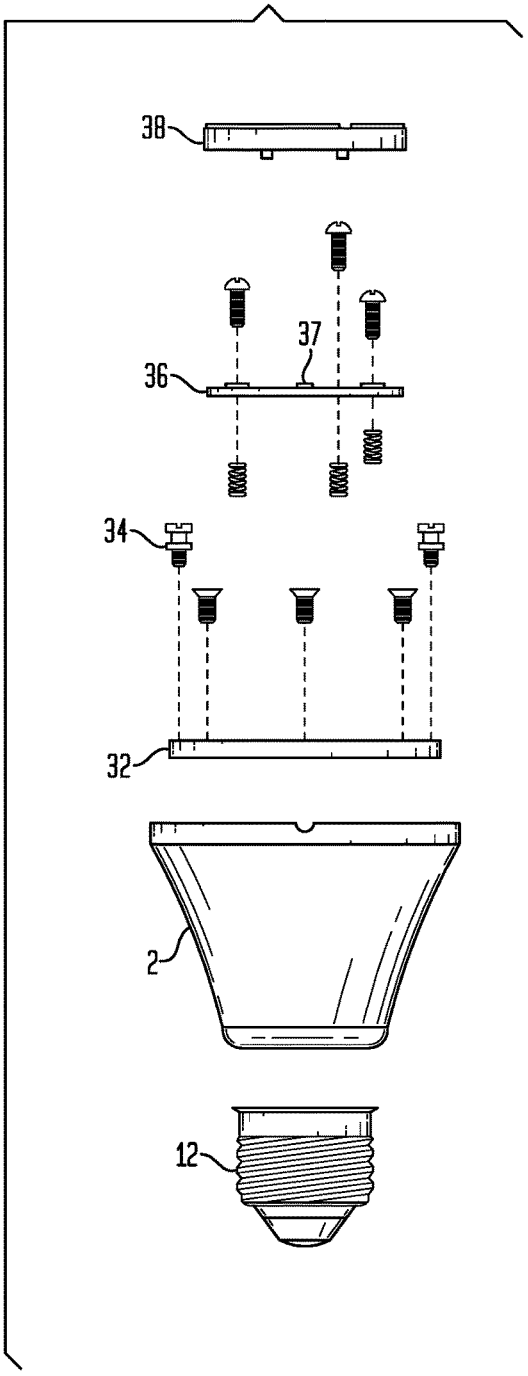
FIG. 6 is a two-dimensional sequential exploded view of components forming the light source assembly shown in FIG. 5.
Figure 6A:
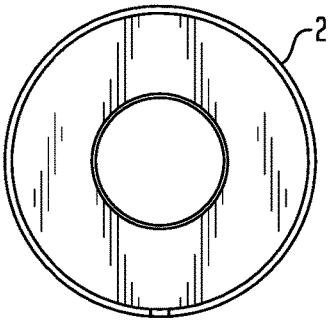
FIG. 6*a* is a top plan view of the conical housing component shown in the FIG. 6 exploded view.
Figure 6B:
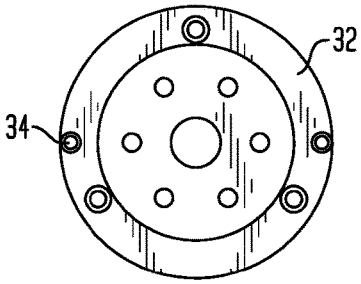
FIG. 6*b* is a top plan view of the heat sink component shown in the FIG. 6 exploded view.
Figure 6C:
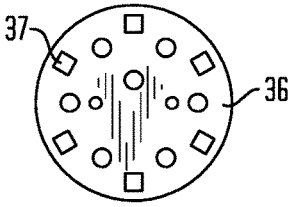
FIG. 6*c* is a top plan view of the LED circuit board component shown in the FIG. 6 exploded view.
Figure 6D:
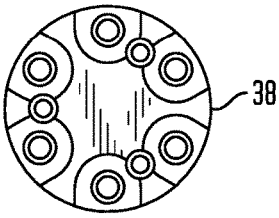
FIG. 6*d* is a top plan view of the LED reflectors component shown in the FIG. 6 exploded view.
Figure 7:
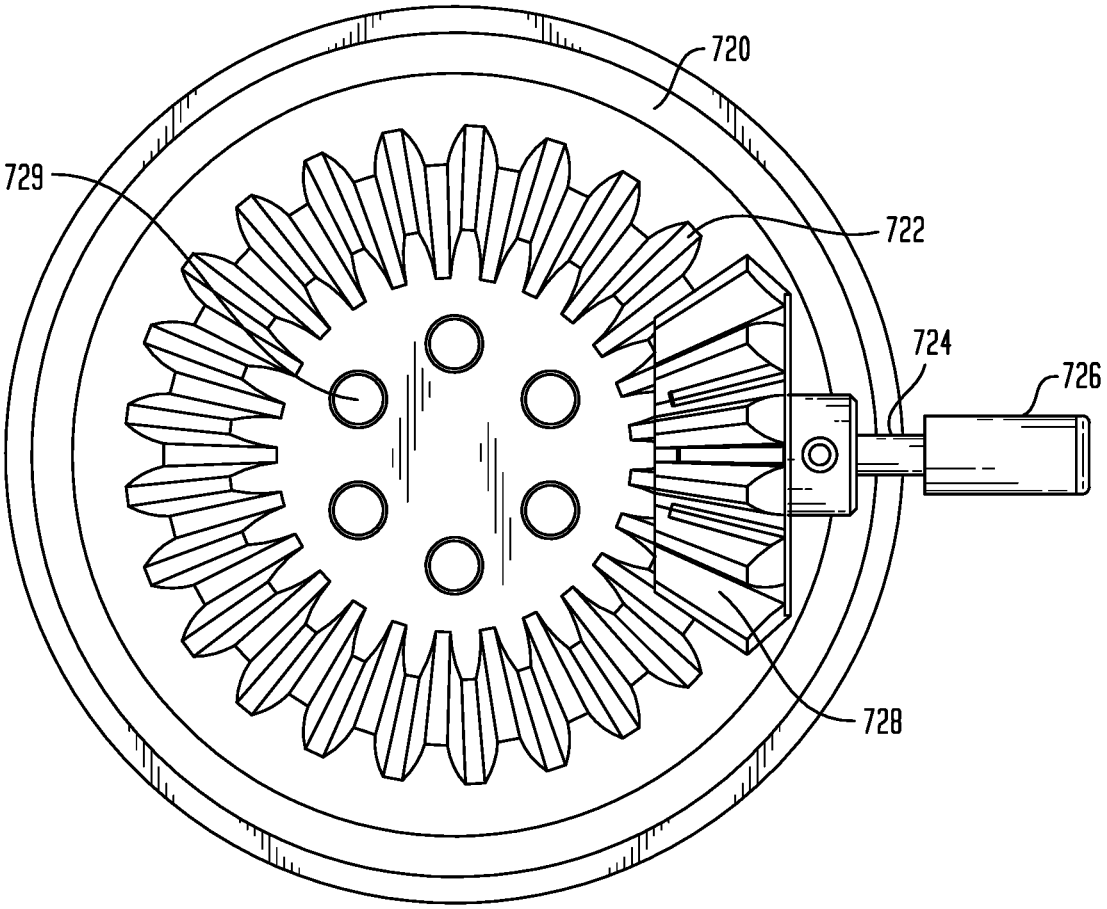
FIG. 7 is a bevel gear assembly for use in the embodiment of FIG. 1-2.

FIG. 5 illustrates the light source in assembled form. An exploded view is shown in FIG. 6 featuring the screw thread 12 at end 8, housing 2 containing LED driver electronics, a heat sink 32, mating pins 34 for attaching the blackout mechanism, LED circuit board 36 with six LED chips 37 and an LED reflector plate 38. FIGS. 5*a* and 6*a* through 6*d* provide top plan views of the assembled and respective components.

FIG. 7-10 illustrates the shutter disc component with various gear types suitable for use in the invention. The gear sets may be selected from bevel, spiral bevel, spur and worm gears. Thus, FIG. 7 describes a shutter disc 720 having six disc apertures 729 and bevel gear teeth 722. Arm 724 at one end has a knob 726 and at an opposite end bevel drive gear teeth 728 for mating with the bevel gear teeth 722.

Figure 8:
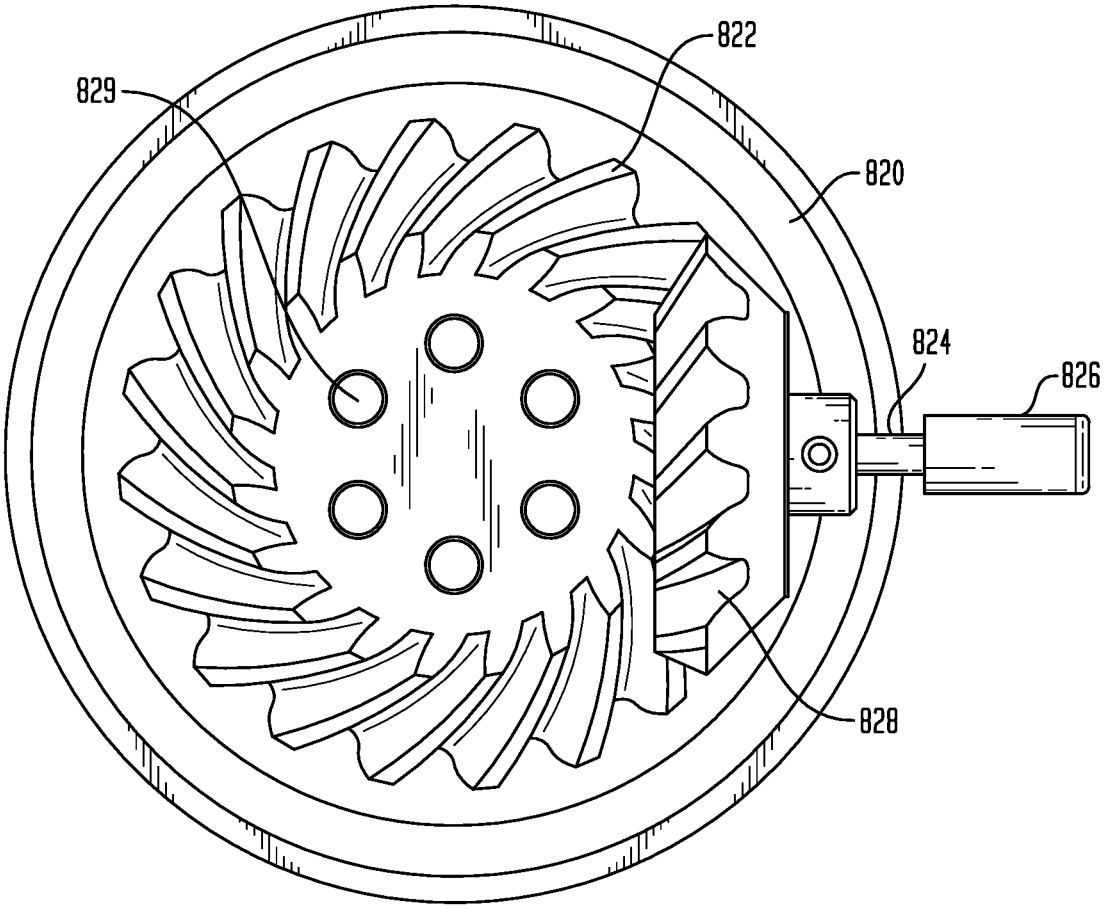
FIG. 8 is a spiral bevel gear assembly for use in the embodiment of FIG. 1-2.

FIG. 8 describes a shutter disc 820 having six disc apertures 829 and spiral bevel gear teeth 822. Arm 824 at one end has a knob 826 and at an opposite end spiral bevel drive gear teeth 828 for mating with the spiral bevel gear teeth 822.

Figure 9:
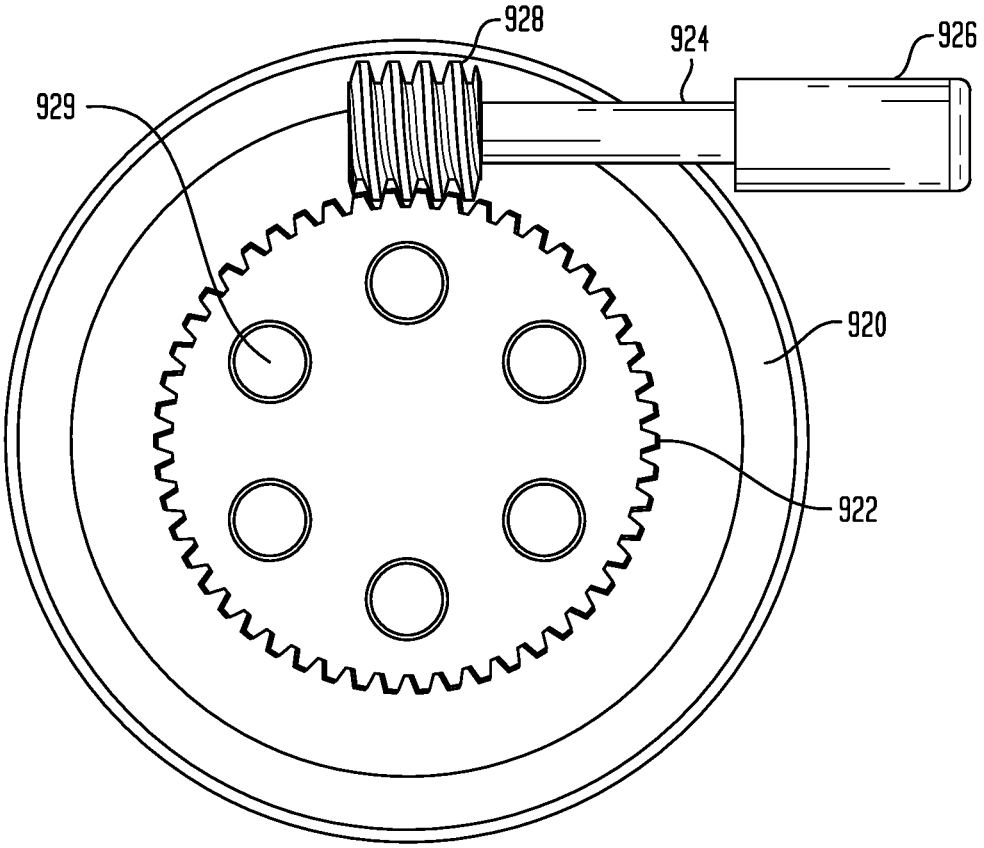
FIG. 9 is a worm gear assembly for use in the embodiment of FIG. 1-2.

FIG. 9 describes a shutter disc 920 having six disc apertures 929 and worm gear teeth 922. Arm 924 at one end has a knob 926 and at an opposite end worm drive gear teeth 928 for mating with the worm gear teeth 922.

Figure 10:
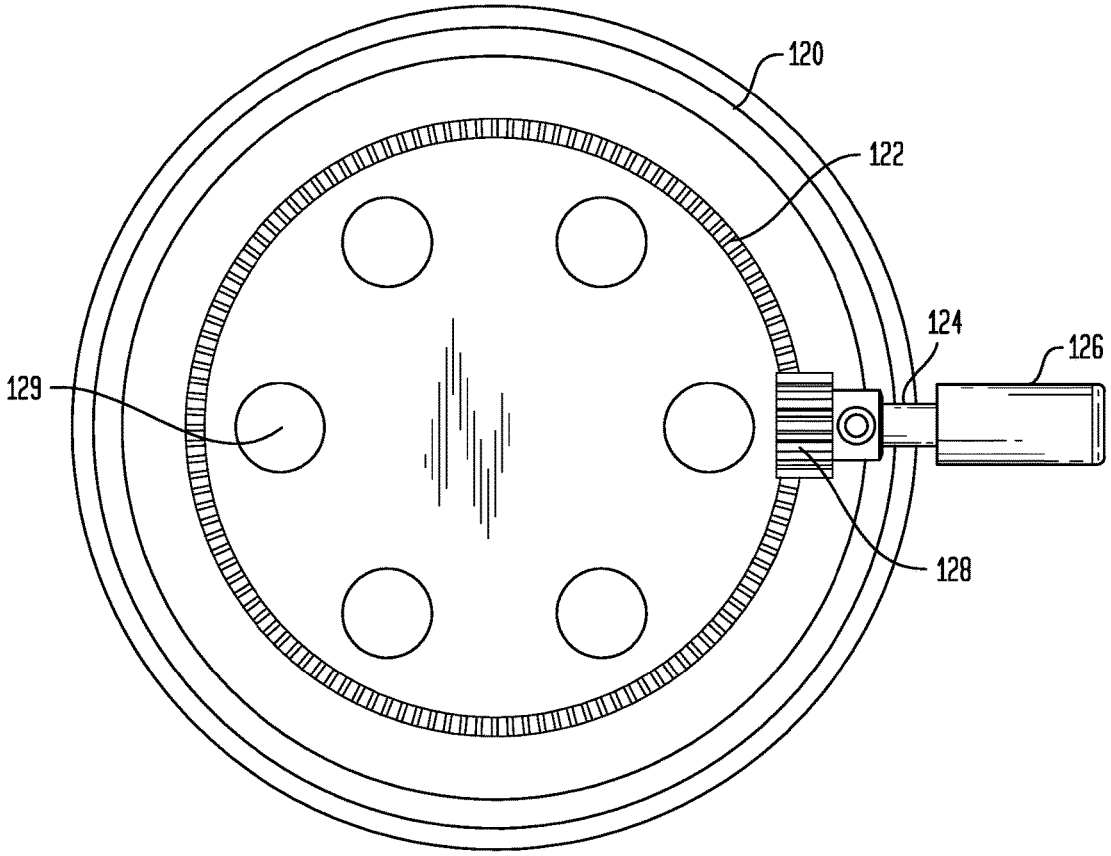
FIG. 10 is a spur gear assembly for use in the embodiment of FIG. 1-2.

FIG. 10 describes a shutter disc 120 having six disc apertures 129 and crown gear teeth 122. Arm 124 at one end has a knob 126 and at an opposite end spur drive gear teeth 128 for mating with the crown gear teeth 122.

For purposes of description herein, singular terminology is meant to incorporate plural equivalents, except where otherwise noted. For instance, 'light source' is meant to include multiple 'light sources' such as several LEDs.

Although the invention has been described in accordance with certain embodiments, it will be seen by those skilled in the art that many modifications can be made within the scope and purview of the invention, and there is no intention to limit the invention solely to these embodiments. Rather, the scope of the invention is to be measured by the appended claims.

What is claimed is:

1. A Shabbat bulb which allows control of illumination without electrical intervention by a person observing strictures of Shabbat orthodox Jewish law, the bulb comprising:

a housing covering an electrically operated light source, the housing having a power connecting end and an oppositely arranged illumination transmitting end, both ends being aligned along a common axis, and a screw thread formed externally on the housing adjacent the power connecting end for connection into an electrical socket;

a blackout mechanism separable from the illumination transmitting end and having no operating connection with electrical circuitry, the mechanism comprising:

a ring oriented around the common axis, an opening formed on a periphery of the ring;

a shutter disc mounted within the ring including at least one disc aperture through which light from the light source is transmitted, the shutter disc having gear teeth arranged along at least a partial circumference of the shutter disc; and an arm projecting radially outward from the shutter disc and projecting through the opening, the arm having drive gear teeth engaging the shutter disc gear teeth, manual rotation of the arm moving the disc apertures from an open position to a closed position thereby allowing full or totally no illumination to exit the bulb via the shutter disc.

2. The bulb according to claim 1 wherein the light source comprises from 2 to 50 electronic chips each with light emitting diodes.

3. The bulb according to claim 2 wherein the electronic chips with light emitting diodes are three to ten in number.

4. The bulb according to claim 1 wherein the disc has six equidistantly arranged disc apertures through which light from the light source is transmitted.

5. The bulb according to claim 1 further comprising a dome shaped light diffusion lens mounted on the ring above the disc.

6. The bulb according to claim 1 wherein the crown gear teeth and drive gear teeth in combination are gear types selected from the group consisting of bevel, spiral bevel, spur and worm gears.

7. The bulb according to claim 1 wherein the open and closed positions being within 30 to 60 degrees distant one another by travel of the drive gear teeth along the crown gear teeth of the shutter disc.

8. The bulb according to claim 1 wherein the shutter disc and crown gear teeth are stamped or molded together as a single component.

9. A method for non-electrically controlling illumination from a light bulb, the method comprising:

obtaining a Shabbat bulb which comprises:

a housing covering an electrically operated light source, the housing having a power connecting end and an oppositely arranged illumination transmitting end, both ends being aligned along a common axis, and a screw thread formed externally on the housing adjacent the power connecting end for connection into an electrical socket;

a blackout mechanism separable from the illumination transmitting end and having no operating connection with electrical circuitry, the mechanism comprising:

a ring oriented around the common axis, an opening formed on a periphery of the ring;

a shutter disc mounted within the ring including at least one disc aperture through which light from the light source is transmitted, the shutter disc having gear teeth arranged along at least a partial circumference of the shutter disc; and an arm projecting radially outward from the shutter disc and projecting through the opening, the arm having drive gear teeth engaging the shutter disc gear teeth, manual rotation of the arm moving the disc apertures from an open position to a closed position thereby allowing full or totally no illumination to exit the bulb via the shutter disc;

inserting the bulb into a power delivery fixture and generating an illumination; and moving the arm from the open to the closed position on Shabbat by a person observing orthodox Jewish law.

* * * * *